US006913487B2

(12) United States Patent
Beneke et al.

(10) Patent No.: US 6,913,487 B2
(45) Date of Patent: Jul. 5, 2005

(54) PLUG-IN CONNECTOR MODULE

(75) Inventors: Andre Beneke, Vechta (DE); Heiko Meier, Rahden (DE); Uwe Sundermeier, Espelkamp (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 10/653,558

(22) Filed: Sep. 2, 2003

(65) Prior Publication Data

US 2004/0053534 A1 Mar. 18, 2004

(30) Foreign Application Priority Data

Sep. 12, 2002 (DE) ..... 202 14 132

(51) Int. Cl.[7] ..... H01R 13/648
(52) U.S. Cl. ..... 439/607
(58) Field of Search ..... 439/607, 610, 439/701, 608, 616

(56) References Cited

U.S. PATENT DOCUMENTS 6,004,162 A 12/1999 Harting et al. ..... 439/701
6,045,390 A 4/2000 Metz et al. ..... 439/405

FOREIGN PATENT DOCUMENTS

| | | | |
|---|---|---|---|
| CH | 692 436 | 12/1997 | ..... H01R/13/66 |
| DE | 296 21 436 | 12/1996 | ..... H01R/13/658 |
| DE | 197 07 120 | 2/1997 | ..... H01R/13/514 |
| DE | 197 12 630 | 3/1997 | ..... H01R/13/502 |
| GB | 2 315 615 | 2/1998 | ..... H01R/13/518 |

*Primary Examiner*—Phuong Dinh
(74) *Attorney, Agent, or Firm*—Hayes Soloway P.C.

(57) ABSTRACT

For the purpose of transmitting signals without interfering radiation, a plug-in connector module is proposed which comprises an electrically conductive shell-type casing, with a connector insert, in a retaining body composed of insulating material. The plug-in connector module is held by locking device in a module mounting device which, in turn, is integrated into a plug-in connector casing. Within the shell-type casing, an electrically conductive contact with the shielding of a signal-carrying cable is provided, so that it is possible to dispose in the module mounting device, without mutual interference, both a plurality of plug-in connector modules having mutually independent earth potentials and plug-in connector modules which transmit a power supply, pneumatic supply or suchlike.

8 Claims, 4 Drawing Sheets

PLUG-IN CONNECTOR MODULE

BACKGROUND OF THE INVENTION

The invention relates to a plug-in connector module with a shielding against interfering radiation. The plug-in connector module is used in a module mounting device of a plug-in connector casing.

Such a plug-in connector module is required so that electrical signals that are susceptible to interference can be transmitted by means of an industrial connector casing in which modules having different power potentials are disposed.

A connector from the prior art, DE 36 15 356 A1, provides a cable connector for connecting a cable to a computer. This cable connector consists of two shell halves that are connected to one another so as to be immune to electrical interference and are coated with thermoplastic material so as to be electrically insulated.

While cable connectors of this type are perfectly adequate for the domain of office communication, they are not sufficiently stable or sufficiently protected against environmental influences for use in the industrial domain.

The instant invention is therefore based on the object of developing a plug-in connector module of the initially stated type, in an industry-standard connector casing with a module mounting device provided therein, such that shielding against interfering radiation is provided for electrical signals which are susceptible to interference and which are routed by means of shielded cables.

This object is achieved by an electrically conductive shell-type casing, with a connector insert, that is retained in a retaining body composed of insulating material. The retaining body, with the shell-type casing and the connector insert, can be locked in place in the module mounting device, and there is provided on the shell-type casing a clip by means of which a signal line, leading to the connector insert, can be fastened. The shielding braid of the signal line contacts the shell-type casing.

SUMMARY OF THE INVENTION

In automation technology, which is increasingly directed towards a decentralized connection technology, there is also an increasing trend to transmit electrically sensitive signals, e.g., from sensors. Such devices, however, must be of a plug-in design in order to assure a rapid, trouble-free replacement of a defective component.

The plug-in connections, however, must be adapted to the industrial domain and robustly equipped.

The advantages achieved by the invention consist particularly in that such a plug-in connector module, provided for so-called D-sub connector inserts, can be inserted in an already known, proven and robust module mounting device in a respective plug-in connector casing. At the same time, due to the type of construction of this plug-in connector module, it is possible to combine without difficulty, and without mutual interference, both a plurality of shielded plug-in connector modules, having mutually independent earth potentials, and plug-in connector modules which transmit a power supply, pneumatic supply or suchlike. The plug-in connector module consists of a retaining body in which is locked an electrically conductive shell-type casing with a D-sub connector insert.

The shielding braid of a shielded cable is connected to the shell-type casing by means of a screw-clip.

A plurality of plug-in connector modules can thus be used independently of one another within a module mounting device, even with different earth potentials on the shieldings.

An exemplary embodiment of the invention, explained more fully in the following, is represented in the drawing, wherein:

DETAILED DESCRIPTION OF THE INVENTION

Figure 1:
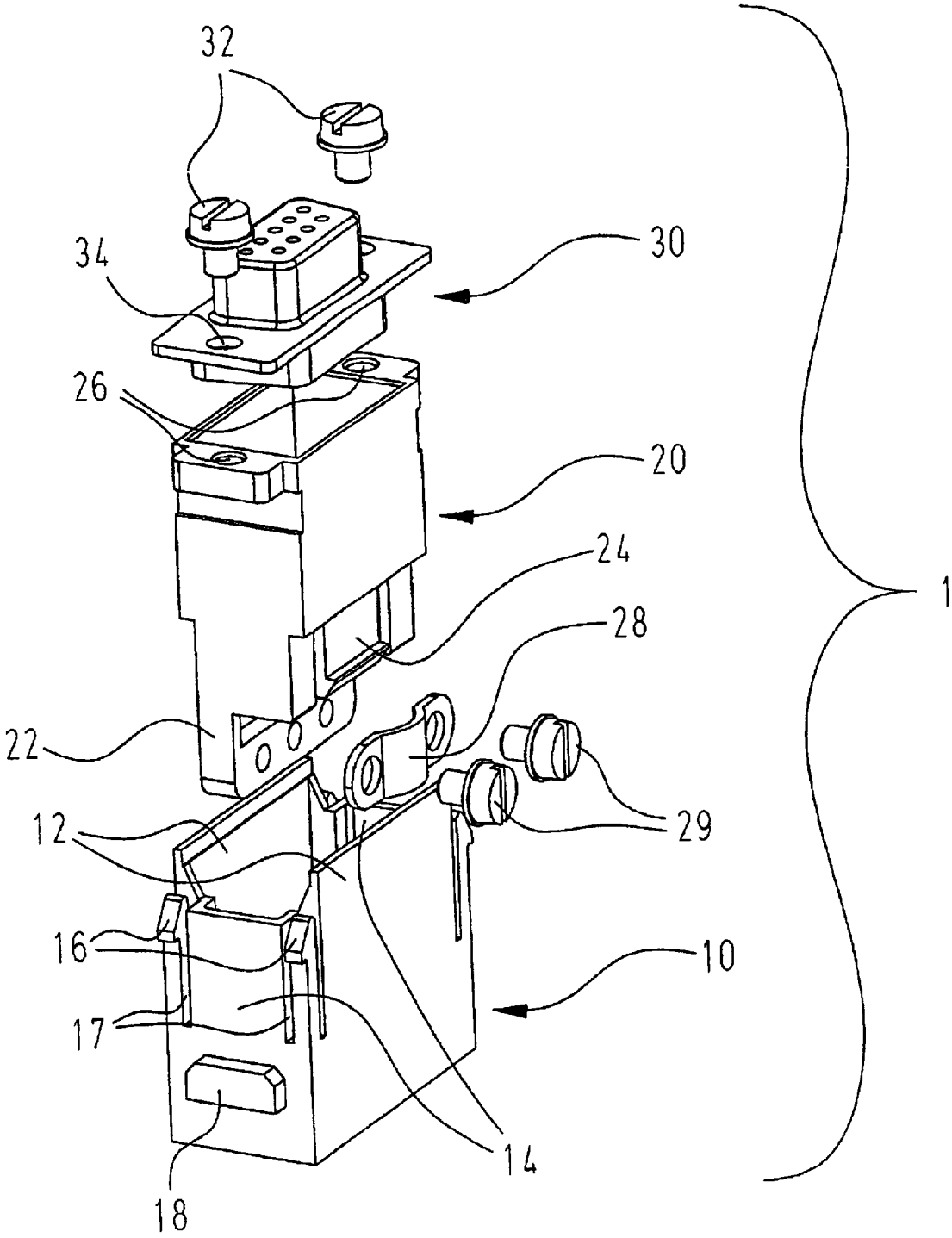
FIG. 1 shows an exploded perspective representation of a plug-in connector module.

FIG. 1 shows, in an exploded representation, the individual elements provided for this plug-in connector module. The module body 10, which is of a rectangular form, is made from a non-conductive material, two opposing side walls being elongated relative to the two side walls 14 disposed perpendicularly to them.

Fashioned in the corner regions are locking hooks 16, each directed outwards, which are relieved from the side walls by means of a rectangular slot 17. Formed on, below and centrally between the locking hooks, are outwardly directed formed-on elements 18 which can be inserted in corresponding openings 44 in a module mounting device 40, shown in FIG. 3.

A shell-type casing 20 can be inserted and locked into the module body 10.

The rectangular shell-type casing comprises a mounting surface 22, elongated relative to the other three side surfaces, for the screw-mounting of a fastening clip 28 by means of which the shielding of a signal cable is contacted to the electrically conductive shell-type casing. In addition, provided on the mating side of casing 20 are threaded holes 26 so that the connector insert 30, which in this case has the form of a D-sub connector, can be fastened to casing 20 using screws 32. Likewise, a fastening with locking means or rivets can be provided.

Figure 2:
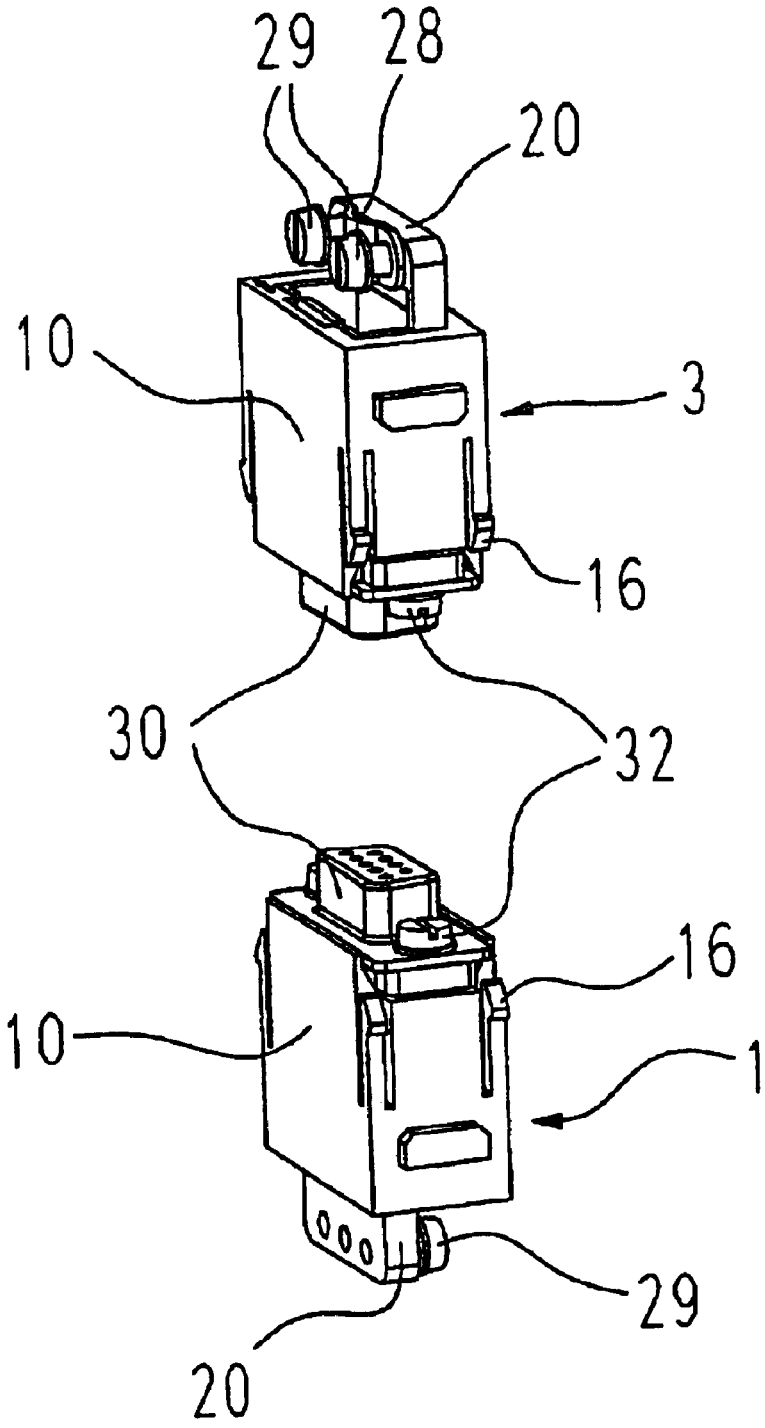
FIG. 2 shows a perspective representation of a plug-in connector module with a mating connector.

FIG. 2 shows a plug-in module 1 and a matching mating connector module 3, each in the assembled but non-mated state with the mating faces being directed towards one another. On the shell-type casing 20, which is locked in the retaining body 10 ,are both screwed connections 29 with the fastening clip 28 for an electrically shielded cable, and the connector inserts 30 with the fastening screws 32.

Figure 3:
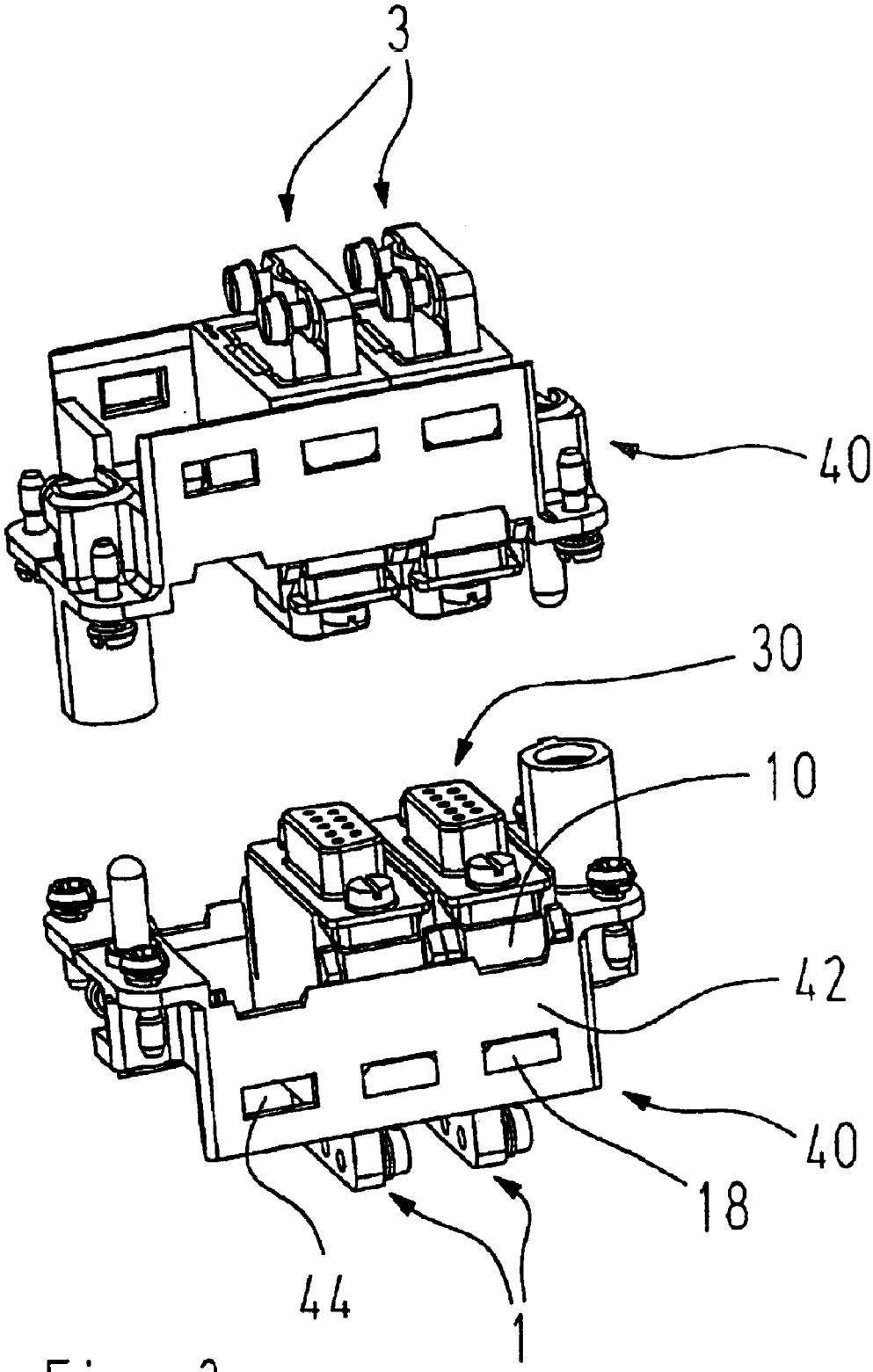
FIG. 3 shows a perspective representation of plug-in connector modules inserted in a module mount.

FIG. 3 shows a plurality of plug-in connector modules disposed in module mounting device 40. The individual modules are positioned in the openings 44 in the mounting frame 40 by means of the formed-on elements 18. The locking hooks 16 lock on the edge of the side surface 42 of the module mounting device 40.

Figure 4:
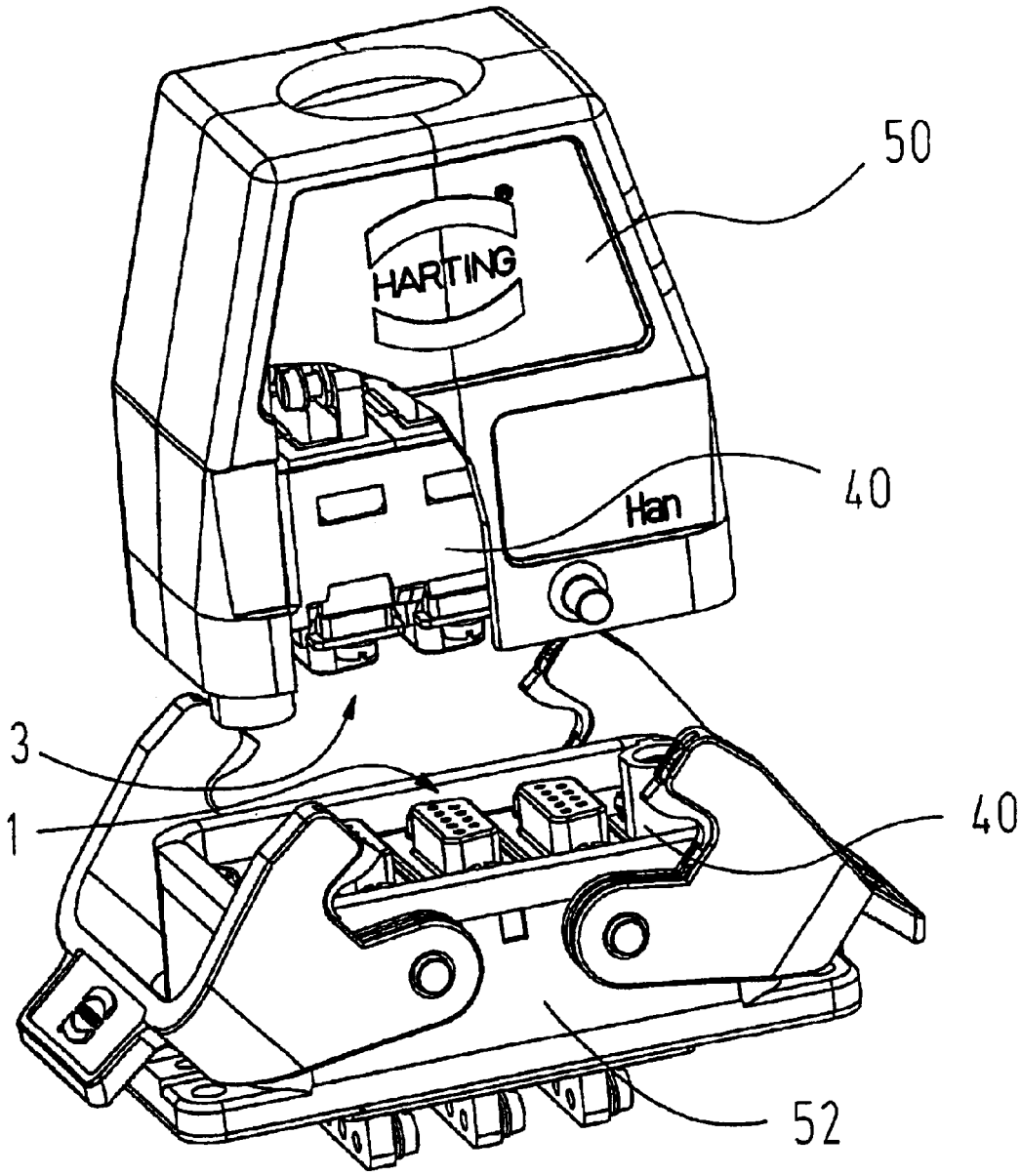
FIG. 4 shows a perspective representation of a module mount with inserted plug-in connector modules in a plug-in connector casing.

FIG. 4 shows a complete plug-in connection with a connector casing 50 and a mating connector casing 52, both connectors being provided with a module mounting device 40 in which the connector modules, in turn, are mounted.

In this figure, the casing 50 has been partially cut away in order to show the module mounting device 40 with the connector modules 1, 3 inserted therein.

What is claimed is:

1. A plug-in connector module with a shielding against interfering radiation, for use in a module mounting device of a plug-in connector casing, wherein said plug-in connector module comprises:

an electrically conductive shell-type casing, with a connector insert;

a retaining body composed of insulating material, the retaining body, with the shell-type casing and the connector insert, being adapted to be locked in place in the module mounting device;

a clip provided on the shell-type casing so that a signal line, leading to the connector insert, may be fastened, and a shielding braid of the signal line contacting the shell-type casing.

2. The plug-in connector module according to claim 1, wherein the shell-type casing is adapted to be looked together with the retaining body.

3. The plug-in connector module according to claim 1, wherein the connector insert is adapted to be fastened in the shell-type casing.

4. The plug-in connector module according to claim 1, wherein the clip is adapted to be fastened to an elongated side surface of the shell-type casing.

5. A plug-in connector module with a shielding against interfering radiation, for use in a module mounting device of a plug-in connector casing, wherein said plug-in connector module comprises:

an electrically conductive shell-type casing, with a connector insert;

a retaining body composed of insulating material, the retaining body, with the shell-type casing and the connector insert, being locked in place in the module mounting device;

a clip provided on the shell-type casing for fixing a shielding braid of a signal line in contact with the shell-type casing.

6. The plug-in connector module according to claim 1, wherein the shell-type casing is locked together with the retaining body.

7. The plug-in connector module according to claim 1, wherein the connector insert is fastened in the shell-type casing.

8. The plug-in connector module according to claim 1, wherein the clip is fastened to an elongated side surface of the shell-type casing.

* * * * *

UNITED STATES PATENT AND TRADEMARK OFFICE

CERTIFICATE OF CORRECTION

PATENT NO. : 6,913,487 B2
DATED : July 5, 2005
INVENTOR(S) : Beneke et al.

It is certified that error appears in the above-identified patent and that said Letters Patent is hereby corrected as shown below:

Column 4,
Lines 14, 17 and 20, "claim 1" should be -- claim 5 --.

Signed and Sealed this

Thirtieth Day of May, 2006

JON W. DUDAS
*Director of the United States Patent and Trademark Office*